US010557226B2

(12) United States Patent
Kim et al.

(10) Patent No.: US 10,557,226 B2
(45) Date of Patent: Feb. 11, 2020

(54) LAUNDRY TREATMENT APPARATUS AND DOOR OF A LAUNDRY TREATMENT APPARATUS

(71) Applicant: LG ELECTRONICS INC., Seoul (KR)

(72) Inventors: Hyunseok Kim, Seoul (KR); Hyunseung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 480 days.

(21) Appl. No.: 14/988,206

(22) Filed: Jan. 5, 2016

(65) Prior Publication Data

US 2016/0194814 A1 Jul. 7, 2016

(30) Foreign Application Priority Data

Jan. 5, 2015 (KR) ..... 10-2015-0000524

(51) Int. Cl.
*D06F 39/14* (2006.01)
*D06F 39/00* (2006.01)
(Continued)

(52) U.S. Cl.
CPC ..... *D06F 39/14* (2013.01); *D06F 39/005* (2013.01); *D06F 39/02* (2013.01); *D06F 58/02* (2013.01);
(Continued)

(58) Field of Classification Search
CPC ..... D06F 39/14; D06F 39/02; D06F 37/28; D06F 58/20; D06F 39/12; D06F 58/04; D06F 58/02
(Continued)

(56) References Cited

U.S. PATENT DOCUMENTS

2007/0130998 A1* 6/2007 Cho ..... D06F 39/12 68/12.01
2008/0141558 A1* 6/2008 Bae ..... D06F 58/04 34/595
(Continued)

FOREIGN PATENT DOCUMENTS

CN 101171385 4/2008
CN 101353855 1/2009
(Continued)

OTHER PUBLICATIONS

Chinese Office Action dated Jun. 13, 2017 issued in Application No. 201610282484.2 (with English Translation).
(Continued)

*Primary Examiner* — Edelmira Bosques
*Assistant Examiner* — Bao D Nguyen
(74) *Attorney, Agent, or Firm* — KED & Associates, LLP

(57) ABSTRACT

A laundry treatment apparatus including a cabinet defining an external appearance, a drum rotatably provided inside the cabinet to accommodate laundry, and a door assembly pivotably provided at the cabinet to open or close an opening in the drum. The door assembly includes a door body configured to open or close the cabinet, a control panel provided on an inner surface of the door body to receive an input related to operation from a user and to display operation of the laundry treatment apparatus, and a control panel cover separably provided on a rear surface of the control panel to define a rear surface of the door assembly. The control panel includes an input unit configured to receive the input related to operation from the user, a display unit configured to display the input received from the input unit, and a PCB configured to control the control panel.

13 Claims, 4 Drawing Sheets

(51) Int. Cl.

| | |
|---|---|
| ***D06F 39/02*** | (2006.01) |
| ***D06F 58/02*** | (2006.01) |
| ***H01H 19/02*** | (2006.01) |
| ***H01H 19/14*** | (2006.01) |

(52) U.S. Cl.
CPC ..... *H01H 19/025* (2013.01); *H01H 19/14* (2013.01); *H01H 2219/036* (2013.01); *H01H 2231/012* (2013.01); *H01H 2231/016* (2013.01)

(58) Field of Classification Search
USPC .... 34/108; 312/228, 326, 321.5, 138.1, 109; 134/57 DL, 58 DL, 56 D, 58 D
See application file for complete search history.

(56) References Cited

U.S. PATENT DOCUMENTS

| | | | | |
|---|---|---|---|---|
| 2009/0217545 | A1* | 9/2009 | Banicevic | D06F 39/005 34/89 |
| 2013/0076220 | A1* | 3/2013 | Yeom | D06F 39/14 312/326 |

FOREIGN PATENT DOCUMENTS

| | | | | |
|---|---|---|---|---|
| CN | 201762574 | | 3/2011 | |
| CN | 1021901653 | | 9/2011 | |
| CN | 103166326 | | 6/2013 | |
| DE | 10 2013 208 851 | | 11/2014 | |
| DE | 102013208851 | A1 * | 11/2014 | D06F 39/005 |
| EP | 0 966 159 | | 12/1999 | |
| EP | 1 568 816 | | 8/2005 | |
| EP | 2 107 152 | | 10/2009 | |
| JP | 8-84891 | | 4/1996 | |
| JP | 3259541 | | 2/2002 | |
| JP | 2002-085891 | | 3/2002 | |
| KR | 10-2001-0055716 | | 7/2001 | |
| KR | 10-2004-0069130 | | 8/2004 | |
| KR | 10-2005-0114362 | | 12/2005 | |
| KR | 10-0593380 | | 6/2006 | |
| KR | 10-0730939 | | 6/2007 | |
| KR | 10-2008-0051639 | | 6/2008 | |
| KR | 10-2010-0054341 | | 5/2010 | |
| WO | WO 02/14593 | | 2/2002 | |
| WO | WO 2010/0128729 | | 11/2010 | |
| WO | WO 2013032224 | A2 * | 3/2013 | D06F 39/02 |

OTHER PUBLICATIONS

Chinese Office Action dated Jul. 4, 2017 issued in Application No. 201610285123.3 (with English Translation).
European Office Action dated Apr. 6, 2017 issued in Application No. 16 150 082.2.
European Search Report dated May 30, 2016 issued in Application No. 16150082.2.
Chinese Office Action dated Aug. 2, 2017 issued in Application No. 201610005386.4.
Chinese Office Action dated Aug. 18, 2017 issued in Application No. 201610285278.7.

* cited by examiner

LAUNDRY TREATMENT APPARATUS AND DOOR OF A LAUNDRY TREATMENT APPARATUS

CROSS-REFERENCE TO RELATED APPLICATION

This application claims the benefit of Korean Patent Application No. 10-2015-0000524, filed on, Jan. 5, 2015, which is hereby incorporated by reference as if fully set forth herein.

BACKGROUND

1. Field

A laundry treatment apparatus and a door of a laundry treatment apparatus.

2. Background

Laundry treatment apparatuses may include a washing apparatus for washing laundry, and a drying apparatus for drying laundry that has been washed in a washing apparatus. When a laundry treatment apparatus is embodied as a washing apparatus, the laundry treatment apparatus may include a cabinet that may define the external appearance of the laundry treatment apparatus, a tub provided inside the cabinet and configured to accommodate wash water, a drum rotatably provided inside the cabinet and configured to accommodate laundry, and a door provided over a portion of the front surface of the cabinet that enables the introduction and discharge of laundry. In addition, the laundry treatment apparatus may further include a control panel which may control the laundry treatment apparatus upon receiving user input and display the cycles of the laundry treatment apparatus.

In a laundry treatment apparatus, the control panel unit is not provided on the door, but is provided on a portion of the top surface of the cabinet or on a front cover, which is provided on a portion of the front surface of the cabinet. Such a construction complicates the fabrication process and causes inconvenience in user manipulation. In addition, in a case where the control panel develops a fault and needs to be repaired, the laundry treatment apparatus inconveniently requires that the front cover be dismantled, or that the control panel, provided on a portion of the top surface or the front cover, be dismantled.

BRIEF DESCRIPTION OF THE DRAWINGS

Embodiments will be described in detail with reference to the following drawings in which like reference numerals refer to like elements, and wherein.

DETAILED DESCRIPTION

Figure 1:
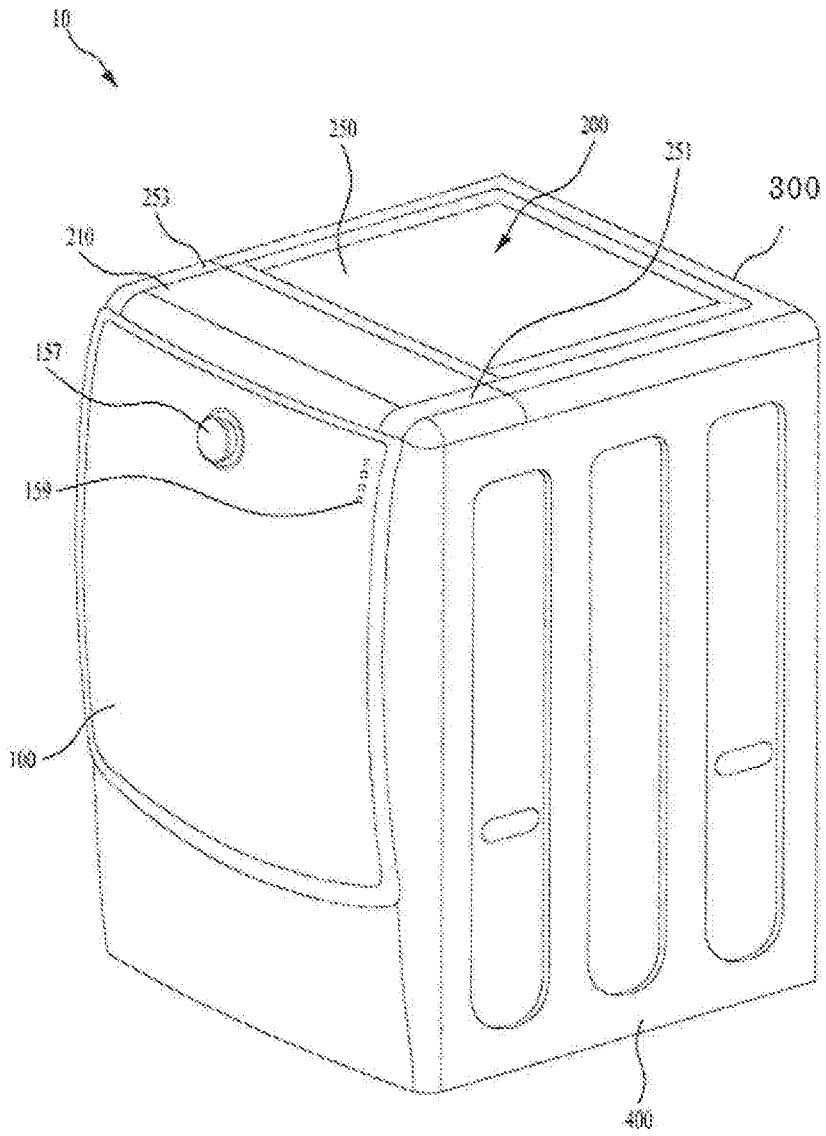
FIG. 1 is a perspective view illustrating a laundry treatment apparatus according to an embodiment.

FIG. 1 is a perspective view illustrating a laundry treatment apparatus according to an embodiment. Referring to FIG. 1, the laundry treatment apparatus according to may include a cabinet 10 that may provide an accommodation space, a drum rotatably provided inside the cabinet 10 and configured to accommodate laundry therein, a motor that rotates the drum, a shaft that has a first side integrated with the motor so as to be integrally rotatable along with the motor and a second side configured to be integrally rotatable with the drum, the shaft transmitting torque of the motor to the drum to rotate the drum, and a door assembly 130 pivotably provided on a portion of the front surface of the cabinet 10 that enables the introduction and discharge of laundry. A detailed description of a laundry apparatus may be found in U.S. Pat. No. 9,187,857, whose entire disclosure is incorporated herein by reference.

The above-described case may pertain to a case in which the laundry treatment apparatus is used as a drying apparatus. In a case where the laundry treatment apparatus is used as a washing apparatus, the laundry treatment apparatus may further include a tub provided inside the cabinet 10 and configured to accommodate wash water therein.

The cabinet 10 may include a front cover unit (or front cover) 100 provided on the front surface of the cabinet 10, a top cover unit (or top cover) 200 provided on the top of the cabinet 10 that may define the top surface of the cabinet 10, and a rear cover 300 and side covers 400 provided on the rear side and lateral sides of the cabinet 10 that may define the rear surface and side surfaces of the cabinet 10. The rear cover 300 and the side covers 400 may be integrally provided, or may be formed as separate members so as to be fastened to one another. The rear cover 300 and the side covers 400 may be integrally formed with one another in the interest of simplifying manufacture and reducing material costs.

Figure 2:
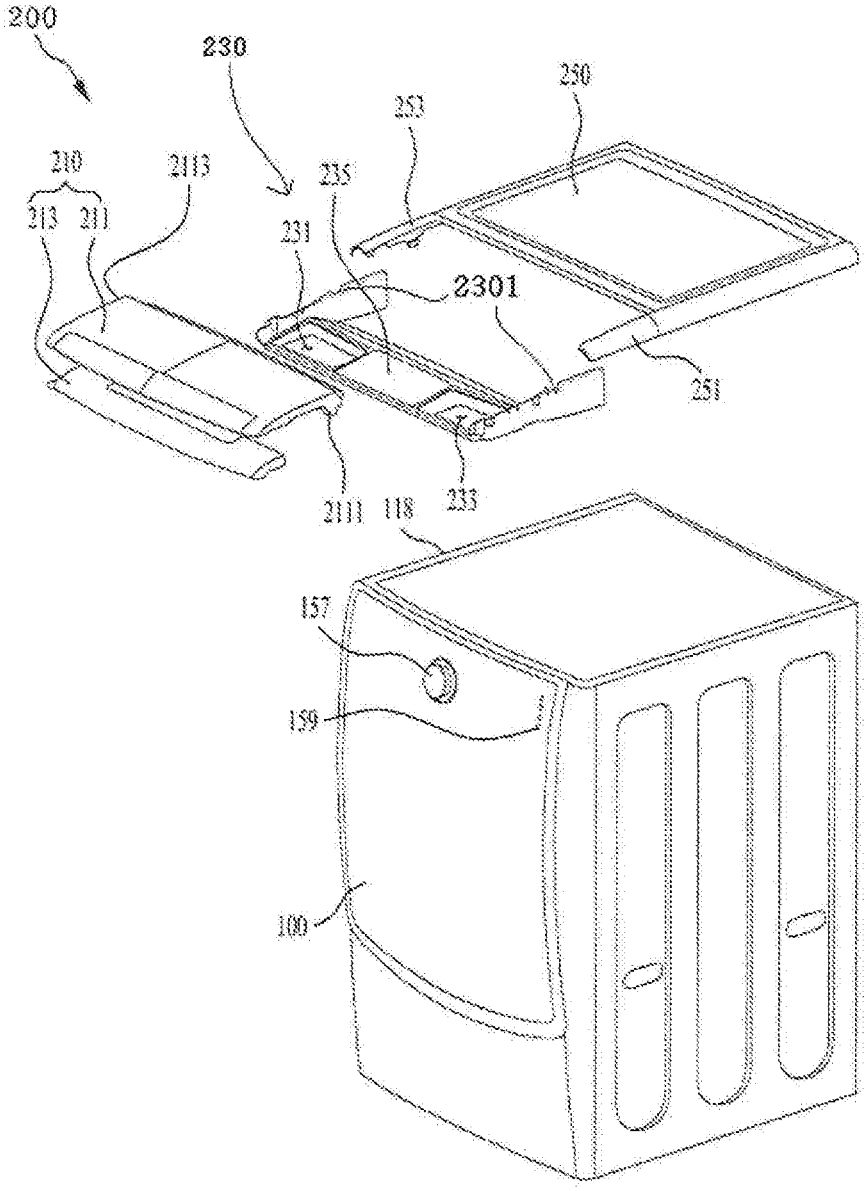
FIG. 2 is an exploded perspective view illustrating a top cover of the laundry treatment apparatus according to an embodiment.
Figure 3:
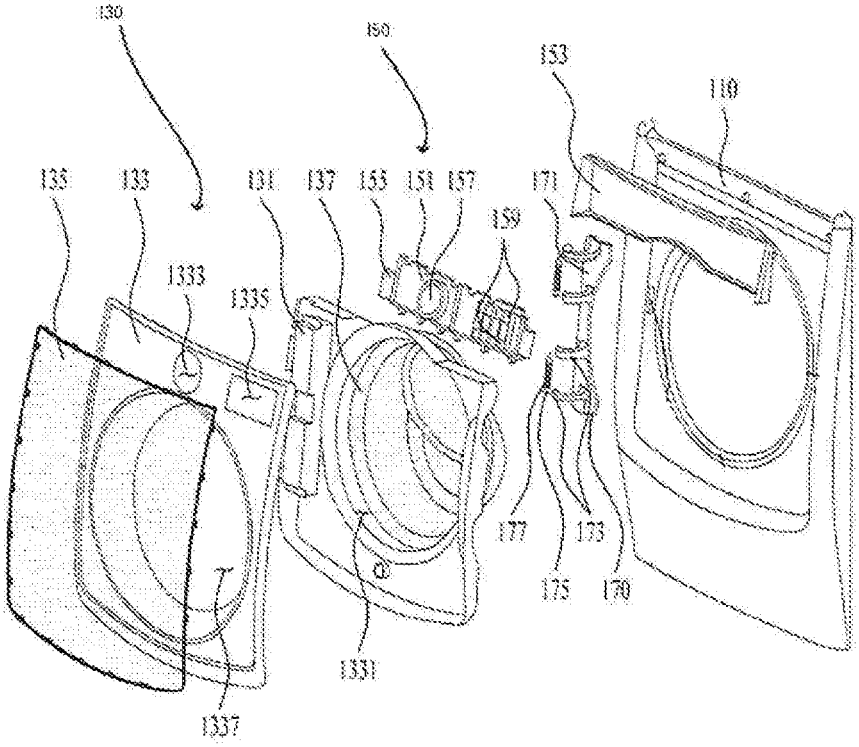
FIG. 3 is a front exploded perspective view illustrating a door assembly of the laundry treatment apparatus according to an embodiment.

Referring to FIGS. 2 and 3, the front cover unit 100 may include a front cover body 110, the door assembly 130 pivotably provided on the front surface of the front cover body 110, and a control panel 150 provided on the door assembly 130 so as to receive user input. The control panel 150 may include an input module 157, which may protrude from the control panel 150 and may be rotatably provided to receive user input, a display module 159, which may receive user input related to operation and display the operation of the laundry treatment apparatus, and a printed circuit board (PCB) to control the control panel 150.

FIG. 2 is an exploded perspective view illustrating the top cover unit of the laundry treatment apparatus according to an embodiment. The input module 157 may include a knob, which may protrude from the control panel 150 and may be rotatably provided, and the display module 159 may include LEDs. The top cover 200 may include a drawer part 210, which may be pulled outward or pushed inward, and a top cover body 250, which may include extensions 251 and 253 protruding forward from the top cover 200 and define a main body of the top cover 200.

Referring to FIG. 2, the top cover 200 may include the drawer part (or drawer) 210, the top cover body 250, and a detergent box assembly 230, which may be provided at the underside of the drawer part 210 and may be configured to accommodate a detergent box or to form an opening of the detergent box. The drawer part 210 may include an upper body 211, which may be pulled out of or pushed into the top cover body 250 and a lower body 213 provided at the underside of the upper body 211. Although the drawer part 210 may be provided so as to be pulled outward or pushed inward, the drawer part 210 may be provided, as needed, so as to be pivotable about coupling portions (or couplers) 2301 at which a first rib 2111 and a second rib 2113, provided at first and second sides of the upper body 211 respectively, and the detergent box assembly 230 are coupled to each other. The first rib 2111 and the second rib 2113 may be provided with bosses, and the coupling portions 2301 may be provided with through-holes or slots, into which the bosses may be fitted to enable the pivoting of the drawer part 210.

The detergent box assembly 230 may include a detergent box body 235 and a first opening 231 and a second opening 233 formed in the detergent box body 235, the first opening 231 being used for the input of detergent and the second opening 233 being used for the input of, for example, fabric softener. Although the present embodiment has described the two openings including the first opening 231 and the second opening 233 by way of example, the number of the openings formed in the detergent box assembly 230 may be changed as needed.

The top cover body 250 may include the first extension 251, which may protrude forward from the right side, and the second extension 253, which may protrude forward from the left side. The right side and the left side are based on a case where the user views the laundry treatment apparatus from the front side thereof. The drawer part 210 may be pulled out of or pushed into the upper cover body 250 as the first rib 2111 is slidably coupled to the first extension 251 and the second rib 2113 is slidably coupled to the second extension 253. That is, the first extension 251 may have a first rail to guide the first rib 2111 so as to slide thereon, and the second extension 253 may have a second rail to guide the second rib 2113 so as to slide thereon.

The first and second ribs 2111 and 2113 and the coupling portions 2301 or the first and second extensions 251 and 253 may have any of various shapes, so long as the drawer part 210 may be pulled outward or pushed inward, or may be pivotable when the user attempts to introduce the detergent into the opening in the detergent box assembly 230, so as to allow the detergent box assembly 230 to be exposed to the user. When the drawer part 210 may be pulled out of or pushed into the upper cover body 250, or may be pivotable, the width of the drawer part 210 may be equal to or less than the width of the upper cover body 250.

The length of the first extension 251 and the second extension 253 may be equal to or greater than the length of both side surfaces of the drawer part 210 because the width of the drawer part 210 may be less than the width of the upper cover body 250. More specifically, the length of the first extension 251 and the second extension 253 may be greater than the length of the side surfaces of the drawer part 210 so that distal ends of the first extension 251 and the second extension 253 may be coupled to the front cover unit 100.

FIG. 3 is a front exploded perspective view illustrating the door assembly of the laundry treatment apparatus according to an embodiment. Referring to FIG. 3, the door assembly 130 may include door bodies 131 and 133 configured to open or close the cabinet 10. The door bodies may include an inner body 131 to open or close the cabinet 10, an outer body 133 provided on a front surface of the inner body 131, and an outer cover 135 provided on a front side of the outer body 133.

The inner body 131 may include a first body hole 1331 having a circular shape, and a door cover 137, which may be provided inside the first body hole 1331 and may be formed of a transparent material to allow the user to observe the interior of the drum from the outside. The outer body 133 may include a knob penetration hole 1333 to enable the penetration of the input module 157, an LED penetration hole 1335 to enable the penetration of the display module 159, and a second body hole 1337 to allow the user to observe the interior of the drum.

The outer cover 135 provided on the front surface of the outer body 133 may be formed of a transparent material. That is, the user may visually check the laundry inside the drum (not illustrated) through the transparent outer cover 135 and the transparent door cover 137. The outer body 133 may further include the control panel 150 detachably attached to the outer body 133. The control panel 150 serves to control the operation of the laundry treatment apparatus according to the embodiment upon receiving user input, and may display the operation of the laundry treatment apparatus according to the embodiment, as described above.

The control panel 150 may include a PCB 151, a PCB support member 155 provided to support the PCB 151, a control panel cover 153 provided on the rear surface of the PCB support member 155 so as to protect the PCB 151, the input module 157 to receive user input, and the display module 159 to display the operation of the laundry treatment apparatus according to the embodiment. The user may input a command to operate the laundry treatment apparatus of the embodiment using the input module 157, and judge, based on the display module 159, whether or not the laundry treatment apparatus is operating in response to the input command.

The door assembly 130 may be pivotably provided on the front cover unit 100 as described above. Accordingly, the door assembly 130 may further include a hinge mechanism 170 separably coupled to the door assembly 130 and the front cover body 110. The hinge mechanism 170 may be coupled to one side of the door assembly 130 and may be provided at one side of the front cover body 110. In this way, the hinge mechanism 170 may serve to pivotably couple the door assembly 130 to the front cover 110.

The hinge mechanism 170 may include a hinge body 171, one or more protrusions 173 protruding forward from the hinge body 171, hinge shafts 175 rotatably provided between the respective protrusions 173, and a spring 177 provided around the outer circumferential surface of each hinge shaft 175 so as to provide counterforce required to prevent the door assembly 130 from being opened or closed by the weight of the door assembly 130. The spring 177 may be a torsional spring.

Figure 4:
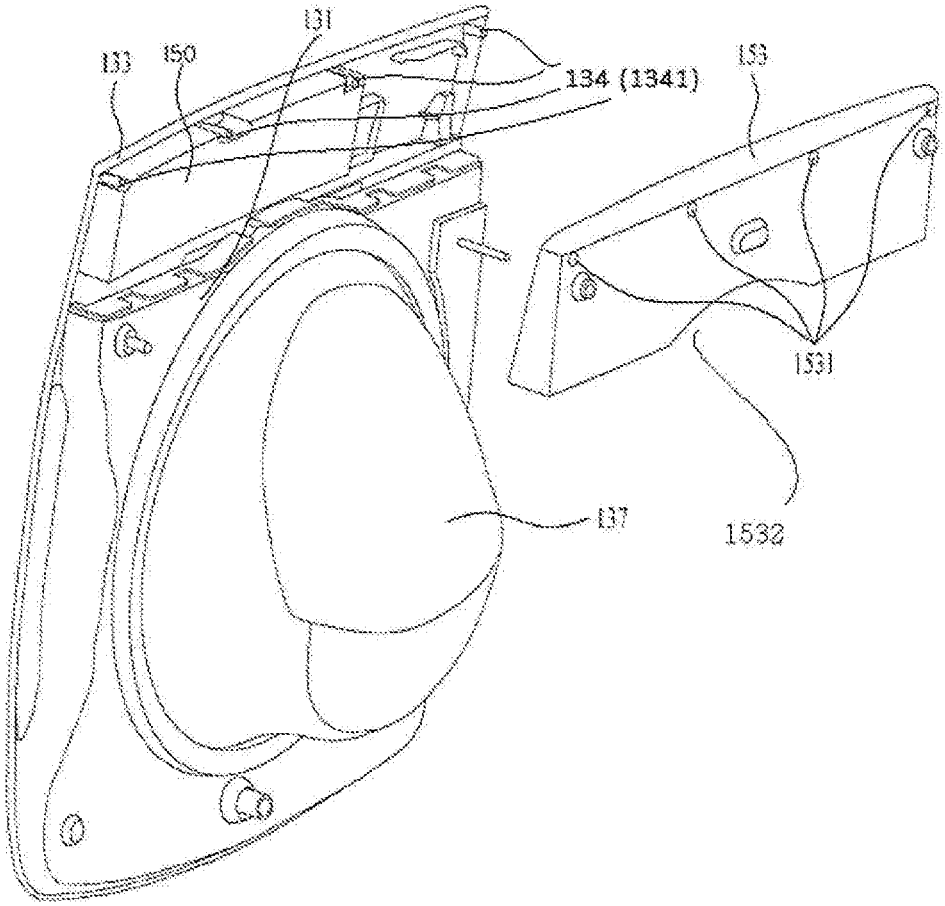
FIG. 4 is a rear exploded perspective view illustrating the door assembly of the laundry treatment apparatus according to an embodiment.

FIG. 4 is a rear exploded perspective view illustrating the door assembly of the laundry treatment apparatus according to an embodiment. Referring to FIG. 4, as described above, the inner body 131 and the outer body 133 may be coupled to each other, and the door cover 137 may be provided to protrude from the inner body 131 toward the drum. The control panel 150 may be coupled to the inner body 131, and the control panel cover 153 may be coupled to the rear surface of the control panel 150. The control panel cover 153 may be formed as a case, one side of which may be open.

Although the control panel cover 153 may take the form of a rectangular cuboid having one open side, it may have any other shape so long as it can protect the PCB 151 in all directions. The control panel cover 153 may need to accommodate the PCB 151 and may need to be perfectly sealed. This is because the control panel 150 may be provided on the inner body 131 of the door assembly 130, and therefore the PCB 151 may be at risk of being exposed to wash water leaking from the drum (not illustrated).

As seen in FIG. 4, fastening members (or protrusions) 134 that may couple the control panel cover 153 to the outer body 133 may be provided at or on the rear surface of the outer body 133. The fastening members 134 may be formed as poles protruding from the rear surface of the outer body 133 and may be provided in a plurality and spaced apart from one another by a prescribed distance along the top surface of a rear portion of the door cover 137.

The control panel cover 153 may have one or more through-holes 1531, and the fastening members 134 may be inserted into the through-holes 1531 so as to fasten the control panel cover 153 and the inner body 131 to each other. Each of the fastening members 134 may centrally have a hole 1341 so as to be fastened to the control panel cover 153 using fastening means such as, for example, a bolt and a nut.

In addition, the control panel cover 153 may be provided at the lower end of the inner body 131 with a curved recess 1532 having a shape corresponding to the shape of the first body hole 1311. The curved recess 1532 may allow the control panel cover 153 to be more closely coupled to the inner body 131 while accommodating the PCB 151. In addition, the curved recess 1532 may prevent the control panel cover 153 from covering the first body hole 1311 even if the control panel cover 153 is coupled to the inner body 131, thereby ensuring the field of view of the user.

As described above, the control panel provided in the conventional laundry treatment apparatus is configured to be directly coupled to the cabinet 10 or to the front cover unit 100, which is inconvenient because the cabinet 10 of the laundry treatment apparatus must be dismantled when the control panel develops a fault. However, in a case where the control panel cover 153 is coupled to the inner body 131 of the door assembly 130 using the fastening members 134 as exemplarily illustrated in FIG. 4, only the control panel cover 153 needs to be disassembled, without dismantling the cabinet 10, and consequently the PCB 151 alone may be easily replaced or repaired.

The laundry treatment apparatus of the embodiments may ensure simplified manufacture and convenient user manipulation, as a result of positioning a control panel on the door. In addition, with the laundry treatment apparatus of the embodiments, in a case where the control panel develops a fault and needs to be repaired, simplified repair of the control panel may be implemented without dismantling the control panel.

A laundry treatment apparatus and a door thereof, may ensure simplified manufacture and convenient user manipulation because a control panel may be provided on the door.

A laundry treatment apparatus and a door thereof, may ensure simplified repair of a control panel unit without dismantling the control panel in a case where the control panel unit develops a fault and needs to be repaired.

A laundry treatment apparatus may include a cabinet defining an external appearance of the laundry treatment apparatus, a drum rotatably provided inside the cabinet to accommodate laundry, and a door assembly pivotably provided at the cabinet to open or close an opening in the drum, wherein the door assembly may include a door body configured to open or close the cabinet, a control panel provided on an inner surface of the door body to receive an input related to operation from a user and to display operation of the laundry treatment apparatus, and a control panel cover separably provided on a rear surface of the control panel to define a rear surface of the door assembly, and wherein the control panel includes an input configured to receive the input related to operation from the user, a display configured to display the input received from the input, and a printed circuit board (PCB) configured to control the control panel.

The control panel cover may have at least one through-hole therein. The control panel and the control panel cover may be separably coupled to each other using a fastening member that penetrates the through-hole. The input may include a knob rotatably protruding from the control panel so as to receive the input from the user.

The display may include an LED configured to display an operating state of the laundry treatment apparatus. The control panel cover may be formed as a case accommodating the control panel. The fastening member may be formed as a pole protruding from the inner surface of the door body so as to be inserted into the through-hole.

The door body may have a body hole having a circular shape, the body hole being covered with a transparent material, and the control panel cover may have a curved recess formed at a lower end thereof so as to correspond to the body hole. The cabinet may include a top cover defining a top surface of the external appearance, and the top cover may include a top cover body forming a main body, a drawer part configured to be pulled out of or pushed into the top cover body or configured to be pivotable, and a detergent box part provided at an underside of the top cover body and the drawer part.

The drawer part may include a first rib provided at one end thereof and a second rib provided at a remaining end thereof. The top cover body may include a first extension configured to be slidably coupled to the first rib and a second extension configured to be slidably coupled to the second rib, such that the drawer is pulled out of or pushed into the top cover body by sliding thereof. The detergent box part may include coupling portions to allow the first rib and the second rib to be pivotably coupled thereto.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a cabinet having an opening in the front;

a drum rotatably provided inside the cabinet; and a door assembly pivotably provided at the cabinet to open or close the opening, wherein the door assembly includes:

an inner body configured to open or close the opening and having a first height, a first surface, and a second surface;

an outer body having a first surface and a second surface, the second surface configured to be coupled to the first surface of the inner body, and having a second height;

a control panel provided on an upper side of the inner body and configured to receive an input from a user and to display information;

a control panel cover provided on a rear surface of the control panel; and an outer cover provided on the first surface of the outer body and formed of a transparent material, wherein the second height is greater than the first height such that a portion of the second surface of the outer body is exposed above the inner body, and wherein the control panel cover is configured to be detachably coupled to the second surface of the outer body and is positioned above the inner body to define a rear upper surface of the door assembly.

2. The apparatus according to claim 1, wherein the control panel cover has at least one through-hole therein.

3. The apparatus according to claim 2, wherein the outer body and the control panel cover are separably coupled to each other using at least one fastening protrusion protruding from the second surface of the outer body that penetrates the at least one through-hole.

4. The apparatus according to claim 3, wherein the fastening protrusion is formed as a pole protruding from the second surface of the outer body so as to be inserted into the at least one through-hole.

5. The apparatus according to claim 3, wherein the control panel is coupled between the outer body and the control panel cover.

6. The apparatus according to claim 1, further comprising an input module that includes a knob rotatably protruding from the control panel to receive the input from the user.

7. The apparatus according to claim 1, wherein the control panel comprises a display, wherein the display includes an LED configured to display an operating state of the laundry treatment apparatus.

8. The apparatus according to claim 1, wherein the control panel cover is formed as a case that accommodates the control panel.

9. The apparatus according to claim 8, wherein the door assembly has a hole having a circular shape, the hole being covered with a transparent material, and the control panel cover has a curved recess formed at a lower end thereof so as to correspond to the hole.

10. The apparatus according to claim 1, wherein the cabinet includes a top cover providing a top surface, and wherein the top cover includes:

a top cover body forming a main body;

a drawer part configured to be pulled out of or pushed into the top cover body or configured to be pivotable; and a detergent box part provided at an underside of the top cover body and the drawer part.

11. The apparatus according to claim 10, wherein the drawer part includes a first rib provided at a first end of the drawer part and a second rib provided at a second end of the drawer part.

12. The apparatus according to claim 11, wherein the detergent box part includes couplers to allow the first rib and the second rib to be pivotably coupled to the detergent box part.

13. The apparatus according to claim 1, wherein the inner body has a first hole having a circular shape.

* * * * *